US009518314B2

(12) United States Patent
Kondoh et al.

(10) Patent No.: US 9,518,314 B2
(45) **Date of Patent: *Dec. 13, 2016**

(54) PRODUCTION METHOD OF EXTRUSION BILLET AND PRODUCTION METHOD OF MAGNESIUM ALLOY MATERIAL

(75) Inventors: Katsuyoshi Kondoh, Minoh (JP); Makoto Hotta, Osaka (JP); Jinsun Liao, Sakai (JP); Kantaro Kaneko, Sakai (JP); Norio Fujii, Nara (JP); Hirohito Kametani, Osaka (JP); Akihiko Koshi, Suita (JP)

(73) Assignees: KURIMOTO LTD., Osaka (JP); Katsuyoshi Kondoh, Osaka (JP)

( * ) Notice: Subject to any disclaimer, the term of this patent is extended or adjusted under 35 U.S.C. 154(b) by 1174 days.

This patent is subject to a terminal disclaimer.

(21) Appl. No.: 12/600,709

(22) PCT Filed: Jun. 19, 2008

(86) PCT No.: PCT/JP2008/061245

§ 371 (c)(1),
(2), (4) Date: Nov. 18, 2009

(87) PCT Pub. No.: WO2009/016894

PCT Pub. Date: Feb. 5, 2009

(65) Prior Publication Data

US 2010/0166593 A1 Jul. 1, 2010

(30) Foreign Application Priority Data

Jul. 31, 2007 (JP) ..... 2007-198556

(51) Int. Cl.
*C22F 1/06* (2006.01)
*B21C 23/00* (2006.01)
(Continued)

(52) U.S. Cl.
CPC ..... *C22F 1/06* (2013.01); *B21C 23/002* (2013.01); *B21C 23/01* (2013.01); *B21C 29/00* (2013.01);
(Continued)

(58) Field of Classification Search
CPC ..... C22F 1/06; B22F 3/20
(Continued)

(56) References Cited

FOREIGN PATENT DOCUMENTS

| | | |
|---|---|---|
| EP | 1 726 385 | 11/2006 |
| EP | 1 770 180 | 4/2007 |

(Continued)

OTHER PUBLICATIONS

T. Sakai et al., "Microstructure and Texture of AZ31 Magnesium Alloy Sheet Produced by High Speed Heavy Rolling", Abstracts of the 109th Autumn Conference of Japan Institute of Light Metals, 2005.

*Primary Examiner* — Weiping Zhu
(74) *Attorney, Agent, or Firm* — Clark & Brody

(57) ABSTRACT

A production method of an extrusion billet includes a step of preparing a plate or lump starting material comprising a magnesium alloy, a step of performing a plastic deformation process at a rolling reduction of 70% or more to the starting material at a temperature of 250° C. or lower to introduce a strain without generating dynamic recrystallization, a step of producing powder by granulating the material after the plastic deformation process, and a step of producing a powder billet by compressing the powder.

7 Claims, 7 Drawing Sheets

(51) Int. Cl.

| | |
|---|---|
| ***B21C 23/01*** | (2006.01) |
| ***B21C 29/00*** | (2006.01) |
| ***B21J 1/02*** | (2006.01) |
| ***B22F 3/20*** | (2006.01) |
| ***C22C 1/04*** | (2006.01) |
| *B21B 1/02* | (2006.01) |

(52) U.S. Cl.
CPC ..... *B21J 1/025* (2013.01); *B22F 3/20* (2013.01); *C22C 1/0408* (2013.01); *B21B 1/024* (2013.01); *B22F 2998/10* (2013.01)

(58) Field of Classification Search
USPC ..... 148/420, 667
See application file for complete search history.

(56) References Cited

FOREIGN PATENT DOCUMENTS

| | | | | |
|---|---|---|---|---|
| JP | 2005-256133 | A | | 9/2005 |
| JP | 2006-348349 | A | | 12/2006 |
| JP | 2006348349 | A | * | 12/2006 |

* cited by examiner

Effect of preheat temperature on recrystallization

PRODUCTION METHOD OF EXTRUSION BILLET AND PRODUCTION METHOD OF MAGNESIUM ALLOY MATERIAL

TECHNICAL FIELD

The present invention relates to production of a magnesium alloy material having a fine crystalline structure and preferable impact energy absorption performance.

BACKGROUND ART

Since a magnesium alloy can be used to reduce the weight of various products due to its low specific gravity, it is widely used in a package of a cellular phone and a portable sound equipment, a car component, a machine component, and a construction material. In order to achieve the more effect of low weight, it is necessary to make the magnesium alloy stronger and tougher. In order to improve such characteristics, the compositions of the magnesium alloy are to be optimized and the crystalline grain of the magnesium alloy is to be miniaturized. Especially, in order to miniaturize the crystalline grain of the magnesium alloy material, methods based on a plastic deformation process such as a rolling method, an extruding method and a drawing method have been used.

Japanese Unexamined Patent Publication No. 2005-256133 discloses a method for miniaturizing a crystalline grain diameter of a powder raw material by a roller compacter. More specifically, starting raw material powder is compressed and deformed through a pair of rolls and then formed into granular powder by a granulating process. The compression deformation and granulating process are performed repeatedly several tens of times, whereby the crystalline grain diameter of the powder becomes fine.

According to the method disclosed in the above document, since it is necessary to perform the compression deformation and the granulating process several tens of times repeatedly to obtain the powder having a fine crystalline grain diameter, there is room for improvement in view of production efficiency and economic efficiency.

Although the crystalline structure can be miniaturized by rolling a magnesium alloy plate material, basal sliding occurs at a low temperature (200° C. or less), since magnesium has a hexagonal close-packed lattice (HCP crystalline structure). Therefore, the degree of cold working of the magnesium alloy plate material is limited to several percents, and the rolling process is performed at 300° C. or higher in general. Even in this case, the rolling process must be performed at a rolling reduction of 25% or less in order to prevent the material from being cracked and fractured.

For example, "Structure and Texture of AZ31 Magnesium Alloy Plate Rolled at High Speed" in Abstracts of the 109th Autumn Conference of Japan Institute of Light Metals (2005) on pages 27 and 28 (by Tetsuo Sakai et al.) discloses a method for obtaining a fine crystalline structure by performing a high-speed rolling process for a magnesium alloy plate. Mr. Sakai et al. focused on the fact that it was necessary to increase a rolling reduction per passage to improve rolling efficiency and to use the rolling for the texture control, the fact that it was necessary to heat up the material to make high reduction rolling successful since only the basal sliding occurred in the magnesium alloy at a low temperature, and the fact that it was necessary to prevent a temperature being lowered due to heat transfer to the roller and a peripheral atmosphere during the process, in order to use heat generation in the process for the material maximally and increase the temperature of the material itself, and thus considered that it was effective to perform the process at high speed to decrease a contact time between the tool and the material, and tried the high-speed rolling. As a result, it has been found that since the rolling processability of the magnesium alloy is improved due to the high-speed rolling, the high reduction rolling can be implemented through one passage, so that an expanded plate material can have a fine grain structure and superior mechanical performance.

According to an experiment result provided by Mr. Sakai et al., it is reported that by the high-speed rolling at rolling speed of 2000 m/min, a rolling reduction of 61% can be implemented through one passage even at 200° C. as well as at 350° C. It is also reported that although a shear band is generated at a rolling temperature of 100° C. or less, as the rolling reduction is increased, a fine recrystallization grain appears in the shear band and the recrystallization grains are spread in the whole plate when the rolling reduction is high.

Although Mr. Sakai et al. estimate that a limit rolling reduction per passage is increased with increase of the rolling speed, a maximum rolling reduction confirmed in the experiment is 62% and it is not clear whether a rolling reduction higher than that can be implemented or not. In addition, according to the method by Mr. Sakai et al., the crystalline grain is miniaturized by use of dynamic recrystallization formed in the magnesium alloy plate during the high-speed rolling. When an extrusion billet is produced from the magnesium alloy material having the fine crystalline structure obtained as described above, and the extruding process is performed at a predetermined temperature, since the fine crystalline grain becomes large at the time of the extruding process, a crystalline structure of a magnesium alloy extrusion material obtained finally becomes large.

DISCLOSURE OF THE INVENTION

It is an object of the present invention to provide a production method of an extrusion billet to obtain a magnesium alloy material having a fine crystalline structure and superior mechanical properties.

It is another object of the present invention to provide a production method of a magnesium alloy material having a fine crystal structure and superior mechanical properties.

A production method of an extrusion billet according to the present invention includes a step of preparing a plate or lump starting material composed of a magnesium alloy, a step of performing a plastic deformation process at a rolling reduction of 70% or more for the starting material at a temperature of 250° C. or less to introduce a strain without generating dynamic recrystallization, a step of producing powder by granulating the material after the plastic deformation process, and a step of producing a powder billet by compressing the powder.

The inventors of this application performed experiments at different temperatures and rolling reductions as conditions for performing the plastic deformation process for the plate or lump magnesium alloy. As a result, it was found that when the rolling reduction was 70% or more, the plastic deformation process was uniformly performed without generating a fracture even at room temperature and a large strain was introduced without generating recrystallization. An upper limit temperature was set to 250° C. in order to prevent dynamic recrystallization. For the extrusion billet provided by compacting the powder in which the large strain is introduced without generating recrystallization, the dynamic recrystallization is generated during extrusion process, and the magnesium alloy material has a fine crystal grain at a final stage.

It is necessary to introduce the large strain during the plastic deformation process in order that the magnesium alloy material after the extruding process may have a finer crystal structure. Thus, it is preferable that the rolling reduction is set to 80% or more. In addition, preferably, the temperature of the starting material before the plastic deformation process is set to 50° C. or less in view of economic efficiency and to surely prevent the dynamic recrystallization.

For one embodiment, the plastic deformation process to introduce the large strain is a rolling process for rolling the starting material between a pair of rolls, and for another embodiment, the plastic deformation process is a pressing process for compressing and deforming the starting material.

A production method of magnesium alloy materials includes a step of preparing a plate or lump starting material composed of a magnesium alloy, a step of performing a plastic deformation process at a rolling reduction of 70% or more for the starting material at a temperature of 250° C. or less to introduce a strain without generating dynamic recrystallization, a step of producing powder by granulating the material after the plastic deformation process, a step of producing a powder billet by compressing the powder, and a step of extruding the powder billet at a temperature of 150 to 400° C.

According to the above method, the magnesium alloy materials have the fine crystalline structures and superior mechanical properties.

BEST MODE FOR CARRYING OUT THE INVENTION

Figure 1:
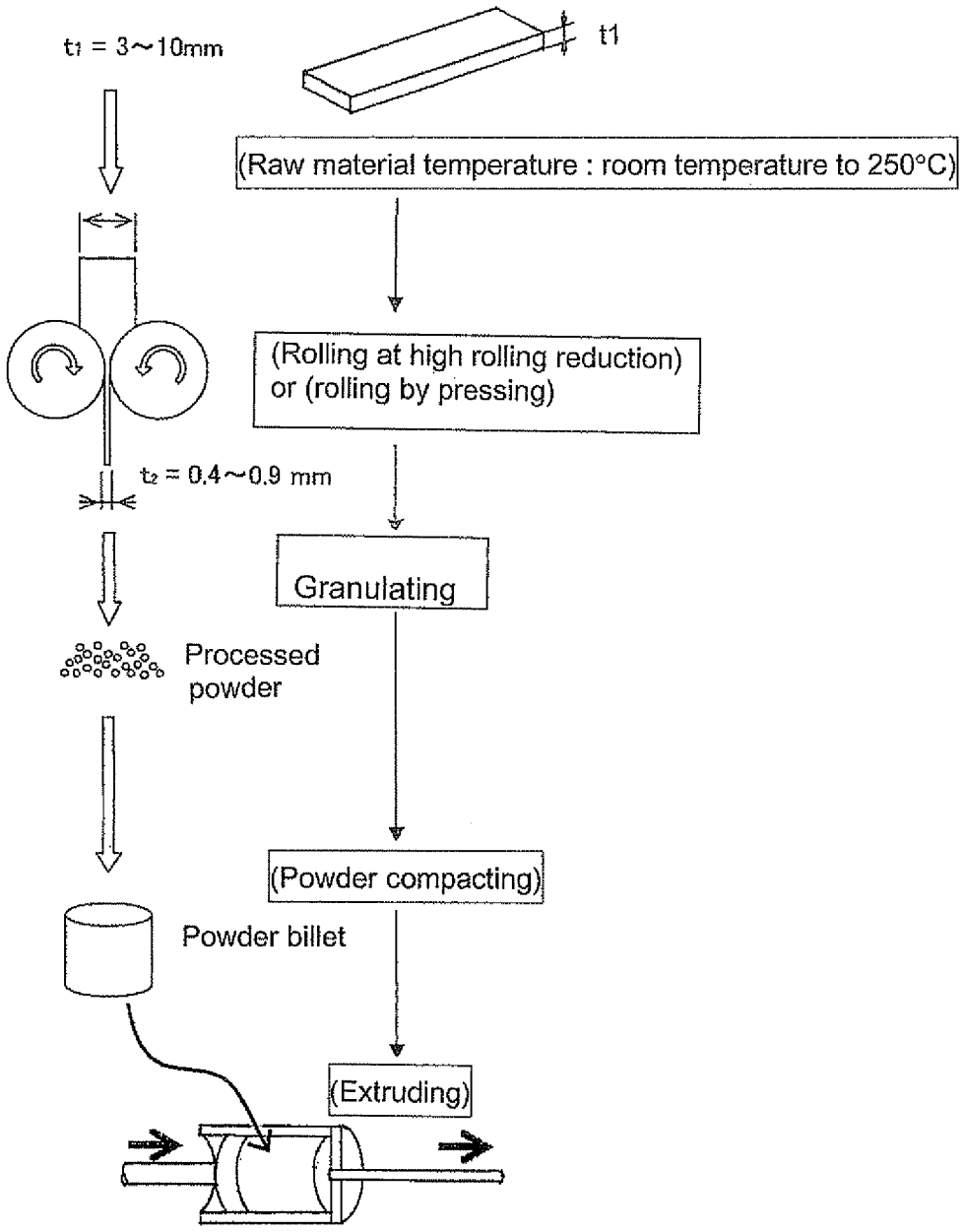
FIG. 1 is a schematic view sequentially showing production steps according to an embodiment of the present invention.

FIG. 1 schematically shows steps of providing a magnesium alloy material having high strength and high impact resistance by processing a plate or lump magnesium alloy starting material.

The starting material is the plate or lump magnesium alloy. According to an embodiment shown in the drawing, a plate material having a thickness "t1" of 3 to 10 mm is used. As a strain is introduced in the starting material in a following plastic deformation process, it is preferable to use a casting material as the starting material because there are many strain introduction sites.

The temperature of the starting material is set to room temperature to 250° C., and the plastic deformation process in which a rolling reduction is 70% or more is performed to introduce a large amount of strains without generating dynamic recrystallization. According to the this embodiment, the plastic deformation process is a rolling process in which a pressure is applied to the starting material between a pair of rolls and the thickness of the plate material becomes 0.4 to 0.9 mm after one pass rolling. The rolling reduction means a thickness reduction rate of the material after the processing.

When it is assumed that the plate thickness of the starting material is 3 mm, and the plate thickness after the plastic deformation process is 0.9 mm, the rolling reduction is as follows.

$$\text{Rolling reduction (\%)}=\{(3.0-0.9)/3.0\}\times 100=70$$

Since magnesium has a HCP crystal structure and only basal sliding occurs at a low temperature, it has been considered that the rolling reduction has to be 20% or less to avoid cracking and fracturing when the magnesium alloy plate material is rolled at room temperature according to conventional technical common knowledge. In general, the magnesium alloy plate material is rolled at 300° C. or more to avoid cracking and fracturing. Even in this case, the rolling reduction is 25% or less.

The inventors of this application rolled the magnesium alloy plate material at room temperature to investigate the relation between the rolling reduction and the cracking of the material. According to the experiment by the inventors of this application, although the material was cracked when the rolling reduction was in a range of 20% to 60%, the material was not cracked when the rolling reduction was 70% or more. This result is beyond the conventional technical common knowledge. This experiment result will be described with reference to photographs below.

As for the plastic deformation process for the starting material, it is important to introduce the large amount of strains without generating dynamic recrystallization. When the material comes to have a recrystallized structure due to the dynamic recrystallization after the plastic deformation process, crystalline grains become large during a later extruding process, so that the final magnesium alloy material does not have the fine crystalline structure. Thus, it is necessary to set the temperature of the starting material before the plastic deformation process to 250° C. or less in order to prevent the dynamic recrystallization. Meanwhile, it is preferable that the temperature of the starting material before the plastic deformation process is set to 50° C. or less in view of economic efficiency and to surely prevent the dynamic recrystallization.

The plastic deformation process for the starting material is not limited to the rolling process, and it may be a pressing process to compress and deform the starting material. In this case also, the above process condition is applied.

After the plastic deformation process to introduce the large amount of strains in the starting material, the material is granulated. Then, the powder is compressed and a powder billet for the extruding process is produced. After the plastic deformation process for the starting material, during the steps until the powder compacting, it is preferable that the powder is put in an atmosphere of inert gas such as nitrogen gas and argon gas to prevent a powder surface from being oxidized.

As a final step shown in FIG. 1, the powder billet is extruded at a temperature of 150 to 400° C. Since the dynamic recrystallization is generated in the material containing the large amount of strains during this extruding process, the magnesium alloy material processed finally has a fine crystalline structure.

Figure 2:
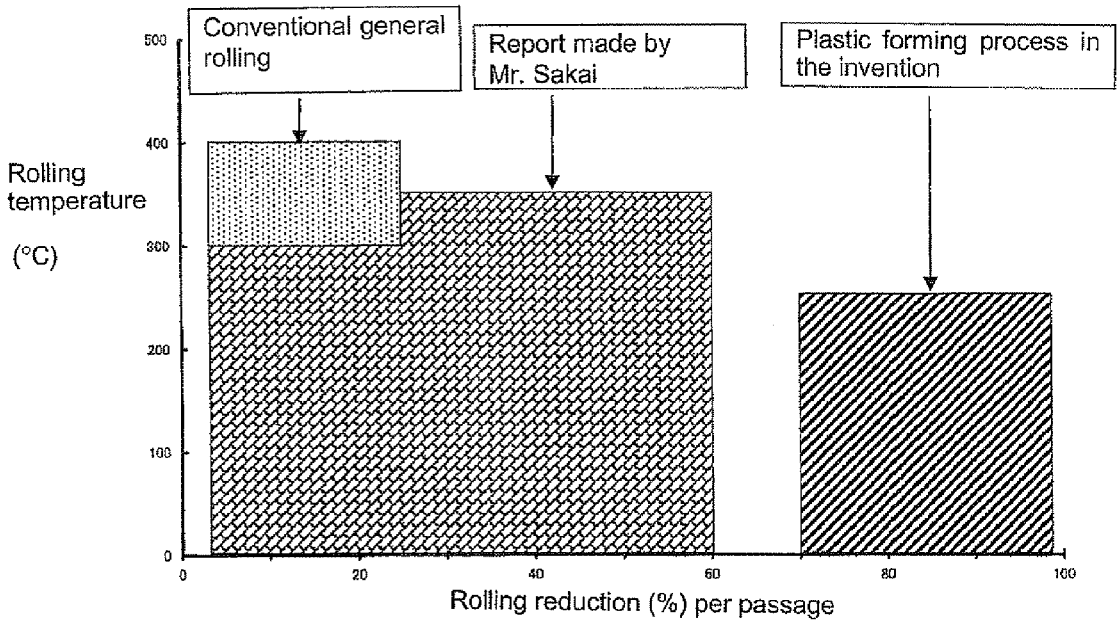
FIG. 2 shows a region of a magnesium alloy material after a conventional general rolling process, a region rolled at high speed as reported by Mr. Sakai et al., and a region after a plastic deformation process according to the present invention, in coordinates in which a rolling temperature is plotted on a vertical axis and a rolling reduction per passage is plotted on a horizontal axis.

FIG. 2 shows a suitable rolling condition range of the conventional general rolling process, the high speed rolling process as reported by Mr. Sakai et al. (Abstracts of the 109th Autumn Conference of Japan Institute of Light Metals (2005)), and the plastic deformation process according to the present invention for a magnesium alloy material, in coordinates in which rolling temperature is plotted on the vertical axis and rolling reduction (%) per one pass is plotted on the horizontal axis.

For the conventional general rolling of the magnesium alloy material, the rolling temperature is 300 to 400° C., and the rolling reduction is 25% or less. For the high-speed rolling reported by Mr. Sakai et al., the rolling temperature is room temperature to 350° C., and the rolling reduction is about 60% or less. For the plastic deformation process in the present invention, the rolling temperature is room temperature to 250° C., and the rolling reduction is 70% or more.

Figure 3:
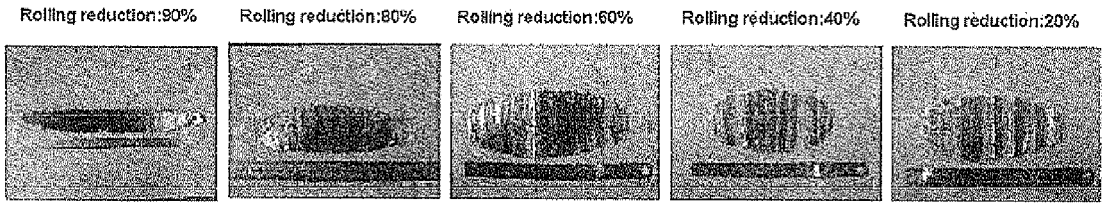
FIG. 3 show photographs of materials after the rolling processes performed at the various rolling reductions.

The inventors of this application rolled the magnesium alloy plate material at room temperature by the rolling process and investigated the relation between the rolling reduction and the cracking of the material. FIG. 3 shows photographs of the materials after the processes. As can be clearly seen from FIG. 3, the material is cracked (fractured) when the rolling reductions are 20%, 40% and 60%. However, when the rolling reductions are 80% and 90%, the large amount of strains can be uniformly introduced to the magnesium alloy material without the fracture of the material. When the rolling process is performed under the condition that the rolling reduction is 80% or more, although the tip end or tail end of the material is cracked a little, it does not become a serious problem since the material will be powdered at the post-process.

Figure 4:
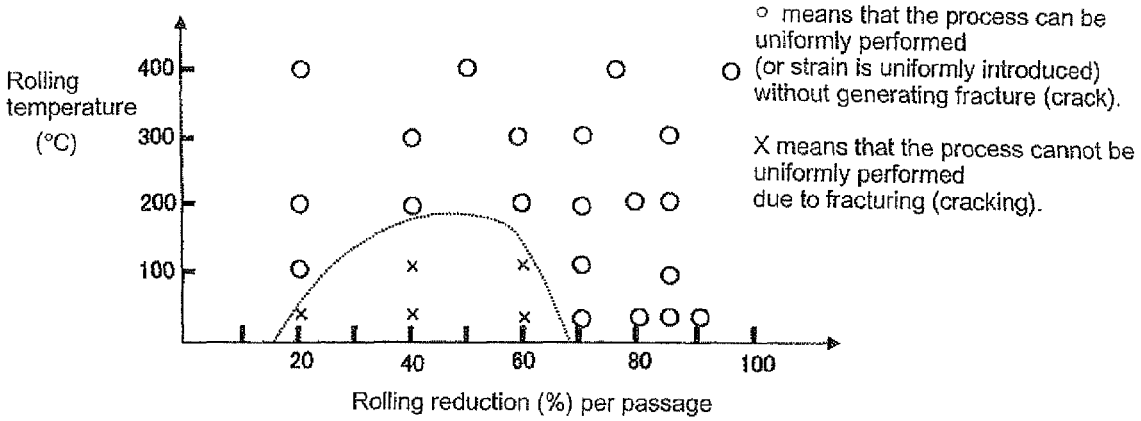
FIG. 4 shows coordinates in which the rolling temperature is plotted on a vertical axis and the rolling reduction per passage is plotted on a horizontal axis, and signs show whether a fracture (crack) is generated or not.

FIG. 4 shows coordinates in which the rolling temperature is plotted on the vertical axis and the rolling reduction (%) per passage is plotted on the horizontal axis, and signs show whether the fracture (crack) arises or not. When the rolling reduction is 20%, although the material is fractured at room temperature, the rolling process can be uniformly performed at the rolling temperature of 100° C. or higher without fracture. When the rolling reduction is 40 to 60%, although the material is fractured at the rolling temperature of 100° C. or lower, the rolling process can be uniformly performed at the rolling temperature of 200° C. or higher without fracture. When the rolling reduction is 70% or more, the rolling process can be uniformly performed at room temperature or higher without fracture.

Figure 5:
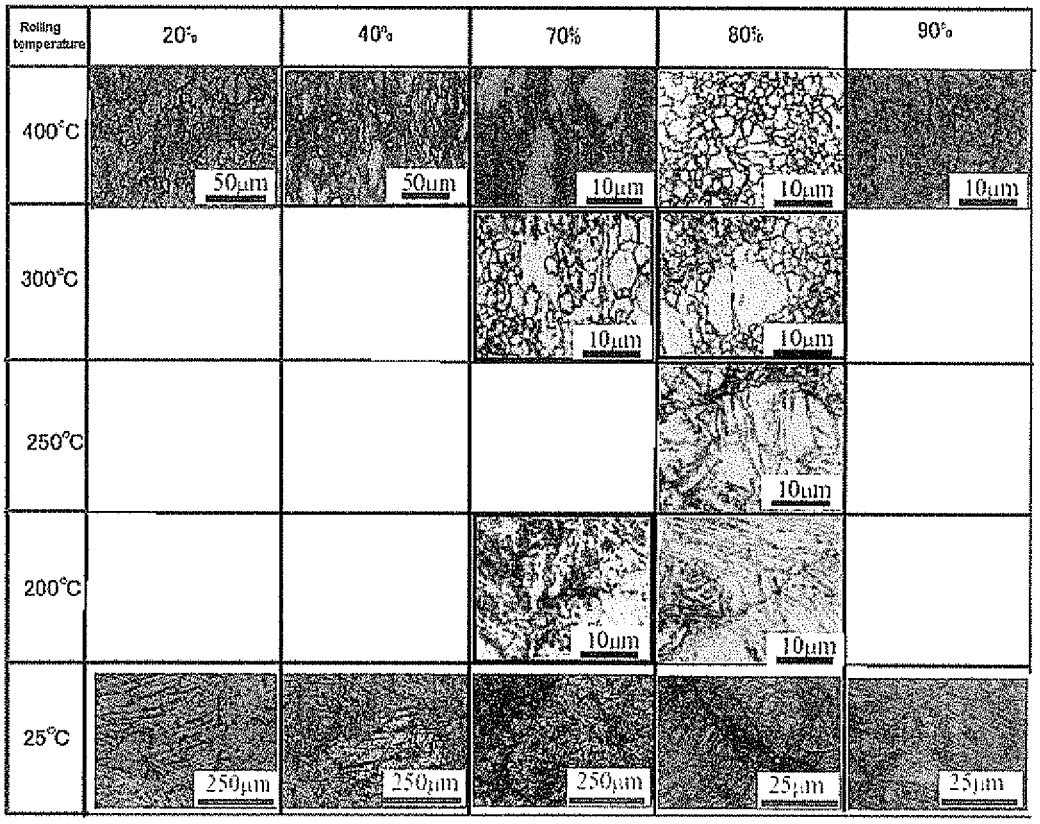
FIG. 5 shows photographs of micro structures of a magnesium alloy after the rolling process.

The inventors of this application has found the relation between a preheat temperature for the rolling process, and the micro structure of the magnesium alloy material after the rolling process. FIG. 5 shows photographs of micro structures.

When the rolling process is performed at the rolling reduction of 20% to 40%, in case that the preheat temperature is 25° C., the material after the process does not have the recrystallized structure, but in case that the preheat temperature is 400° C., it has a structure recrystallized due to the dynamic recrystallization. When the rolling process is performed at the rolling reduction of 70%, in case that the preheat temperature is 200° C. or lower, the material after the process does not have the recrystallized structure, but in case that the preheat temperature is 300° C. or higher, it has a structure recrystallized due to the dynamic recrystallization. When the rolling process is performed at the rolling reduction of 80%, in case that the preheat temperature is 200° C. or lower, the material after the process does not have the recrystallized structure at all, but in case that the preheat temperature is 250° C., it has been confirmed that only a part of the material is crystallized due to the dynamic recrystallization. In addition, when the preheat temperature is set to 300° C. or more while the rolling reduction is set to 80%, almost the whole structure is crystallized due to the dynamic recrystallization. Therefore, an important point is that the upper limit of the preheat temperature is set to 250° C. When the rolling process is performed at the rolling reduction of 90%, in case that the preheat temperature is set to 25° C., the material does not have the recrystallized structure, but in case that the preheat temperature is set to 400° C., the material is crystallized.

Figure 6:
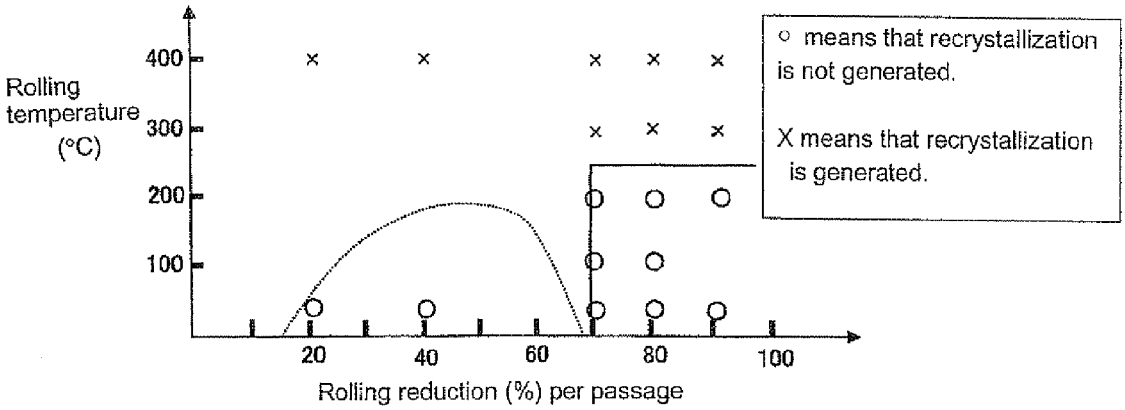
FIG. 6 shows coordinates in which the rolling temperature is plotted on a vertical axis and the rolling reduction per passage is plotted on a horizontal axis, and signs show whether recrystallization is generated or not.

FIG. 6 shows coordinates in which the rolling temperature is plotted on the vertical axis and the rolling reduction (%) per passage is plotted on the horizontal axis, and signs show whether the recrystallization is generated or not. When the rolling reduction is 70% or more and the rolling temperature is 250° C. or lower, the rolling process can be performed without the recrystallization.

Figure 7:
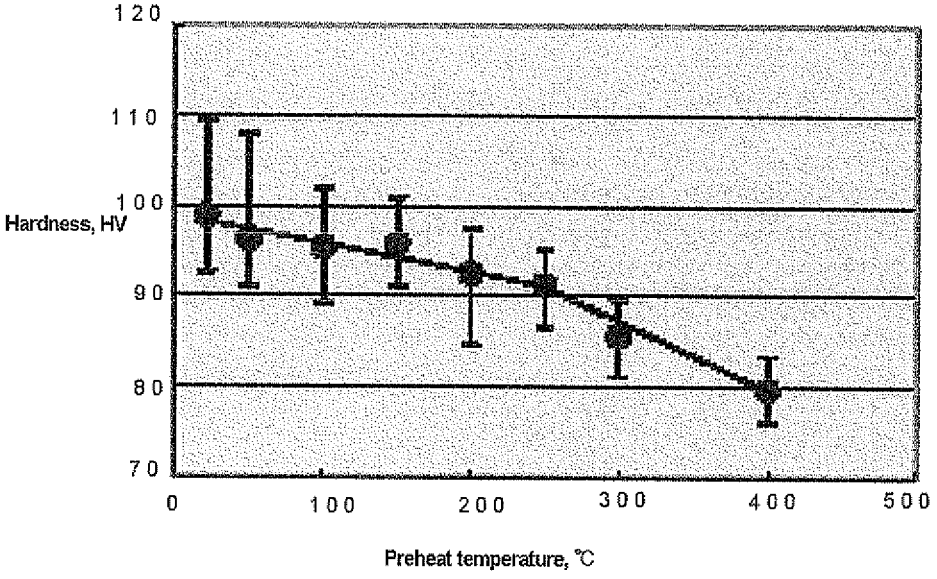
FIG. 7 is a view showing a relation between a preheat temperature of a magnesium alloy starting material before the rolling process at a rolling reduction of 80%, and hardness of the magnesium alloy material after the rolling process.

FIG. 7 is a view showing a relation between the preheat temperature of the magnesium alloy starting material for the rolling process at the rolling reduction of 80%, and hardness of the magnesium alloy material after the rolling process. In case that the rolling process is performed when the preheat temperature of the starting material is 250° C. or less, the hardness (Hv) of the magnesium alloy material after the rolling process is 90 or more. Meanwhile, in case that the rolling process is performed when the preheat temperature is 300° C. or more, the hardness (Hv) of the magnesium alloy material after the rolling process is less than 90.

The inventors of this application changed the configuration of the starting raw material of the magnesium alloy, the rolling conditions, and the extruding conditions, and then compared the mechanical characteristics of the finally obtained magnesium alloy materials. Its result is shown in Table 1.

TABLE 1

*Effect of dynamic recrystallization and rolling reduction in rolling process

| | Section | Inventive example | | | Lack of strain | Excessive rolling temperature | Conventional example |
|---|---|---|---|---|---|---|---|
| | Test No. | D71 | D78 | P1 | B1* | D4 | A15** |
| | Starting raw material | Plate material (casting) | Plate material (casting) | Lump material (casting) | Rod material (casting) | Plate material (casting) | Casting material |
| Rolling process | Process method for strain | Rolling process | Rolling process | Pressing process | Machining process | Rolling process | — |
| | Rolling temperature (preheat temperature) [° C.] | 25 | 25 | 25 | 25 | 400 | — |
| | Rolling reduction [%] | 84 | 84 | 90 | — | 97 | — |
| | Generation of recystallization | No | No | No | No | Yes | — |
| | Average crystalline grain diameter after rolling process [μm] | (Strain introduction) | (Strain introduction) | (Strain introduction) | (Strain introduction) | 1.35 | — |
| Extruding process | Configuration of extrusion material | ϕ 16 round bar | ϕ 16 round bar | ϕ 16 round bar | ϕ 16 round bar | ϕ 16 round bar | ϕ 16 round bar |
| | Extrusion temperature | 400 | 200 | 200 | 400 | 400 | 400 |
| | Outlet temperature of extrusion process [° C.] | 444 | (No record) | 326 | 385 | 456 | 415 |
| | Extrusion material average crystalline grain diameter [μm] | 3.36 | 1.36 | 2.15 | 5.27 | 4.91 | 3.46 |
| Mechanical characteristics of material | Tensile strength [MPa] | 280.8 | 300.8 | 294.2 | 282.0 | 260.7 | 285.9 |
| | Yield stress [MPa] | 190.1 | 232.1 | 228.8 | 191.8 | 165.9 | 201.7 |
| | Extension [%] | 25.4 | 29.6 | 29.8 | 21.3 | 21.9 | 22.0 |
| | Hardness [Hv] | 63.9 | 72.8 | — | 63.4 | 58.4 | 65.2 |
| | Impact absorption energy [J] | 30.1 | 34.2 | 35.5 | 19.7 | 18.3 | 13.9 |

Note :
*The material is produced by extruding a chip provided by cutting a casting.
The cutting operation gives plastic deformation (or strain) to the chip.
It is estimated that a strain amount corresponds to the strain provided when rolling reduction is about 40%.
**The material is produced by extruding a casting directly.

According to the test No. D71 as an inventive example, the rolling process in which the rolling reduction was 84% was performed to a plate material of a casting magnesium alloy as a starting raw material at a temperature (preheat temperature of the starting raw material) of 25° C. with a pair of rolls, and then the extruding process was performed therefor at an extrusion temperature of 400° C. The material after the rolling process did not have the recrystallized structure. The average crystalline grain diameter of the extruded material after the extruding process was 3.36 μm. As for the mechanical characteristics of the final magnesium alloy material, it was confirmed that the tensile strength, yield stress, elongation, hardness, and impact absorption energy were improved.

According to the test No. D78 as an inventive example, the rolling process in which the rolling reduction was 84% was performed to a plate material of a casting magnesium alloy as a starting raw material at a temperature of 25° C. with a pair of rolls, and then the extruding process was performed therefor at an extrusion temperature of 200° C. The material after the rolling process did not have the recrystallized structure. Since the extrusion temperature during the extruding process was low as compared with the test No. D71, the average crystalline grain diameter of the extruded material was as smaller as 1.36 μm, and the mechanical characteristics such as the tensile strength, yield stress, elongation, hardness, and impact absorption energy of the final magnesium alloy material were all improved.

According to the test No. P1 as an inventive example, a compression deformation process in which the rolling reduction was 90% was performed for a lump material of a casting magnesium alloy as a starting raw material by pressing at a temperature of 25° C., and then the extruding process was performed therefor at an extrusion temperature of 200° C. The material after the rolling process did not have the recrystallized structure. Since the extrusion temperature during the extruding process is low as compared with the test No. D71, the average crystalline grain diameter of the extrusion material was as smaller as 2.15 μm, and the mechanical characteristics such as the tensile strength, yield stress, elongation, and impact absorption energy of the final magnesium alloy material were all improved.

According to the test No. B1 as a comparative example, a chip was cut from a rod of a casting magnesium alloy as a starting raw material by a machining process, and the chip was extruded by the extruding process at 400° C. The plastic deformation (or strain) was introduced to the chip by the machining process. It is estimated that the strain amount in the chips corresponds to the strain in the rolled material at the rolling reduction of about 40%. The average crystalline grain diameter of the extruded material from the chips was considerably larger than the inventive example and as large as 5.27 μm. In addition, as for the mechanical characteristics of a final magnesium alloy material, the elongation and the impact absorption energy were inferior to the inventive example.

According to the test No. D4 as a comparative example, the rolling process in which the rolling reduction was 97% was performed to a plate material of a casting magnesium alloy as a starting raw material at a temperature of 400° C.

with a pair of rolls, and then the extruding process was performed therefor at an extrusion temperature of 400° C. Since the temperature during the rolling process was higher than the inventive example, the material after the rolling process had a recrystallized structure. The crystalline grain diameter of the recrystallized structure was as fine as 1.35 μm. Since the fine crystalline structure became coarse during the extruding process, the average crystalline grain diameter of the extruded material was 4.91 μm that was larger than the inventive example. As the result, the mechanical characteristics of a final magnesium alloy material, such as the tensile strength, yield stress, elongation, hardness, and impact absorption energy were all inferior to the inventive example.

According to the test No. A15 as a conventional example, a casting magnesium alloy was directly extruded by the extrusion process at a temperature of 400° C. The average crystalline grain diameter of the extruded material was 3.46 μm that was larger than the inventive example. As the result, the mechanical characteristics of a final magnesium alloy material, such as the elongation and impact absorption energy were inferior to the inventive example Although the embodiments of the present invention have been described with reference to the drawings in the above, the present invention is not limited to the above-illustrated embodiments. Various kinds of modifications and variations may be added to the illustrated embodiments within the same or equal scope of the present invention.

INDUSTRIAL APPLICABILITY

The present invention can be advantageously applied to the production of the magnesium alloy material having the fine crystalline grain diameter and having the preferable impact energy absorption performance.

The invention claimed is:

1. A production method of an extrusion billet comprising the steps of:

preparing a plate starting material comprising a magnesium alloy and having a thickness of 3 mm to 10 mm;

performing a plastic deformation process at a rolling reduction of 70% or more to said plate starting material at a temperature of 250° C. or lower to introduce a strain without generating dynamic recrystallization;

producing powder by granulating the material after said plastic deformation process; and producing a powder billet by compressing said powder.

2. The production method of the extrusion billet according to claim 1, wherein the temperature of said plate starting material during said plastic deformation process is set to 50° C. or lower.

3. The production method of the extrusion billet according to claim 1, wherein the rolling reduction of said plastic deformation process is set to 80% or more.

4. The production method of the extrusion billet according to claim 1, wherein said plastic deformation process comprises a rolling process for rolling said plate starting material using a pair of rolls.

5. The production method of the extrusion billet according to claim 1, wherein said plastic deformation process comprises a pressing process for compressing and deforming said plate starting material.

6. A production method of a magnesium alloy material comprising the steps of:

preparing a plate starting material comprising a magnesium alloy and having a thickness of 3 mm to 10 mm;

performing a plastic deformation process at a rolling reduction of 70% or more to said plate starting material at a temperature of 250° C. or lower to introduce a strain without generating dynamic recrystallization;

producing powder by granulating the material after said plastic deformation process;

producing a powder billet by compressing said powder; and extruding said powder billet at temperatures of 150 to 400° C.

7. The production method of the magnesium alloy material according to claim 6, further comprising conducting the granulating step and compressing step in an inert gas atmosphere to prevent a surface of the powder from being oxidized during the granulating and compressing steps.

* * * * *